US011577898B2

(12) United States Patent
Harris et al.

(10) Patent No.: US 11,577,898 B2
(45) Date of Patent: Feb. 14, 2023

(54) BAY DOOR RECYCLABLE DOSEPAK

(71) Applicant: WestRock MWV, LLC, Atlanta, GA (US)

(72) Inventors: Robert P. Harris, Henrico, VA (US); James D. Knotts, Glen Allen, VA (US)

(73) Assignee: WestRock MWV, LLC, Atlanta, GA (US)

( * ) Notice: Subject to any disclaimer, the term of this patent is extended or adjusted under 35 U.S.C. 154(b) by 3 days.

(21) Appl. No.: 17/014,076

(22) Filed: Sep. 8, 2020

(65) Prior Publication Data

US 2021/0070517 A1 Mar. 11, 2021

Related U.S. Application Data

(60) Provisional application No. 62/896,901, filed on Sep. 6, 2019.

(51) Int. Cl.

| | |
|---|---|
| ***B65D 75/32*** | (2006.01) |
| ***B65D 73/00*** | (2006.01) |
| ***B65D 83/04*** | (2006.01) |

(52) U.S. Cl.

CPC ..... *B65D 75/327* (2013.01); *B65D 73/0078* (2013.01); *B65D 83/0463* (2013.01)

(58) Field of Classification Search

CPC ..... B65D 75/327; B65D 73/0078; B65D 83/0463; B65D 75/367; B65D 2572/367

USPC ..... 206/528–540, 461–471

See application file for complete search history.

(56) References Cited

U.S. PATENT DOCUMENTS

| | | | | |
|---|---|---|---|---|
| 3,327,843 | A * | 6/1967 | O'Meara | B65D 73/0092 206/532 |
| 3,356,210 | A * | 12/1967 | Lilly | B65D 75/36 206/469 |
| 3,371,777 | A * | 3/1968 | Lilly | B65D 75/368 206/469 |
| 4,200,193 | A * | 4/1980 | Boyle | B65D 75/366 206/461 |
| 5,484,631 | A * | 1/1996 | Hoh | B29D 7/01 206/461 |
| 6,439,390 | B1 * | 8/2002 | Kumakura | B65D 75/367 206/469 |
| 6,896,138 | B2 | 5/2005 | Rock et al. | |
| 7,207,440 | B2 | 4/2007 | Briscoe | |
| 7,506,761 | B2 * | 3/2009 | Levy | B65D 73/0007 206/459.5 |
| 7,673,752 | B2 * | 3/2010 | Levy | B65D 73/0078 206/528 |
| 7,789,233 | B2 * | 9/2010 | Levy | B65D 5/542 206/459.5 |
| 10,265,246 | B2 | 4/2019 | Dantsker et al. | |
| 2006/0016711 | A1 * | 1/2006 | Ritter | B65D 73/0092 206/470 |
| 2006/0042986 | A1 * | 3/2006 | Simkowski | B65D 75/366 206/470 |
| 2006/0102512 | A1 * | 5/2006 | Lo Duca | B65D 83/0463 206/531 |

(Continued)

*Primary Examiner* — Chun Hoi Cheung

(74) *Attorney, Agent, or Firm* — Rohini K. Garg

(57) ABSTRACT

A packaging comprising: (a) an outer card having one or more cavities; and (b) one or more blister cards housed within the one or more cavities, wherein the one or more blister cards are removable from the one or more cavities so that the one or more blister cards are disposable separate from the outer card.

21 Claims, 8 Drawing Sheets

(56) References Cited

U.S. PATENT DOCUMENTS

| | | | | |
|---|---|---|---|---|
| 2011/0031148 | A1* | 2/2011 | Rosendall | B65D 73/0078 206/459.1 |
| 2011/0278192 | A1* | 11/2011 | Thornton | B65D 73/0092 206/464 |
| 2015/0014203 | A1* | 1/2015 | Upchurch | B65D 77/22 206/462 |

* cited by examiner

BAY DOOR RECYCLABLE DOSEPAK

CROSS-REFERENCE TO RELATED APPLICATIONS

This application claims the benefit of U.S. Provisional Patent Application No. 62/896,901, filed Sep. 6, 2020, which is incorporated herein by reference in its entirety.

FIELD

The present teachings generally relate to blister cards, and more particularly, to packaging with removable blister cards.

BACKGROUND

Blister packs are frequently used for a variety of consumer goods that are generally smaller in size and purchased in volume. While blister packs are used in a variety of consumer industries, the pharmaceutical industry often utilizes blister packs as a means for unit-dose packaging of pharmaceuticals that may be in the form of tablets, capsules, lozenges, or a combination thereof. The blister packs may be used to divide individual tablets, capsules, lozenges, or a combination thereof within formed apertures in the blister card sealed by a foil or film disposed over the apertures. A user of the blister card may then puncture or split the foil or film to remove the individual pharmaceutical, thereby leaving the remaining pharmaceuticals sealed.

Often times, one or more blister packs may be contained within an outer card made of one or more recyclable materials. The outer card may include one or more cavities the retain the blister packs, thereby allowing a plurality of blister packs to be packaged together while also providing additional structural integrity. However, while the outer card may be recyclable, the blister packs secured to the outer card often contains non-recyclable materials. As a result, both the blister packs and the outer card are considered waste and disposed of accordingly.

Examples of blister packs can be found in U.S. Pat. Nos. 6,896,138; 7,207,440; and 10,265,246, all of which are incorporated by reference herein for all purposes. There remains a need for a more environment-friendly packaging. What is needed is packaging that is at least partially recyclable. There remains a need for packaging having a removable blister pack. What is needed is packaging that is able to secure one or more blister packs in a removable manner. There remains a need for an easily accessible blister card that can be accessed through an outer card. What is needed is an outer card having one or more bay doors, perforations, punch outs, or a combination thereof to access one or more blister packs.

SUMMARY

The present teachings meet one or more of the present needs by providing a packaging comprising: (a) an outer card having one or more cavities; and (b) one or more blister cards housed within the one or more cavities, wherein the one or more blister cards are removable from the one or more cavities so that the one or more blister cards are disposable separate from the outer card.

The present teachings meet one or more of the present needs by providing a packaging, wherein: the one or more blister cards are removed through one or more bay doors of the packaging; the outer card includes a shell forming the one or more cavities and a backing secured to the shell; the one or more bay doors are located on the backing of the outer card and the one or more bay doors are joined to each other by one or more perforations; the one or more perforations are split when a squeezing force is applied to outer edges of the backing; each bay door includes punch outs that align with corresponding apertures of the one or more blister cards secured within the one or more cavities so that one or more items secured within the apertures are removed without opening the bay doors; the one or more blister cards include a coating on one or more surfaces to prevent adhesion between the one or more blister cards and the backing, the shell, or both; a hole is positioned along the one or more bay doors so that a user may manually split the one or more perforations; at least one of the one or more bay doors includes a tab so that a user may manually split the one or more perforations; the shell further includes apertures within an area forming the one or more cavities that align with the apertures of the one or more blister cards secured in the one or more cavities; the outer card is recyclable once the one or more blister cards are removed from the packaging; the backing and the shell are secured to one another via a sealant between the backing and the shell; the sealant is at least partially disposed around the one or more cavities so that the one or more blister cards remain unadhered or only partially adhered to the outer card; or a combination thereof.

The present teachings meet one or more of the present needs by providing a packaging, wherein: once the one or more perforations are split, the one or more bay doors hingedly pivot relative to the backing and the one or more bay doors remain secured to the backing when opened; the one or more bay doors are monolithically formed with the backing; the coating disposed on the one or more blister cards is an ultraviolet (UV) coating; the squeezing force applied to the outer edges of the backing results in the outer card being bent, thereby splitting the one or more perforations; the sealant between the backing and the shell has a thickness of less than about 10 mm; the one or more blister cards are removed from the one or more cavities by applying a force to an outer portion of the shell forming the one or more cavities; the outer shell is a paperboard; the one or more blister cards are removed from the outer card by separating the backing from the shell; the one or more blister cards are free of adherence with the backing, the shell, or both so that the one or more blister cards can be removed from the one or more cavities; or a combination thereof.

The present teachings meet one or more of the present needs by providing: a more environment-friendly packaging; packaging that is at least partially recyclable; packaging having a removable blister pack; packaging that is able to secure one or more blister packs in a removable manner; an easily accessible blister card that can be accessed through an outer card; and an outer card having one or more bay doors, perforations, punch outs, or a combination thereof to access one or more blister packs.

DETAILED DESCRIPTION

Figure 1:
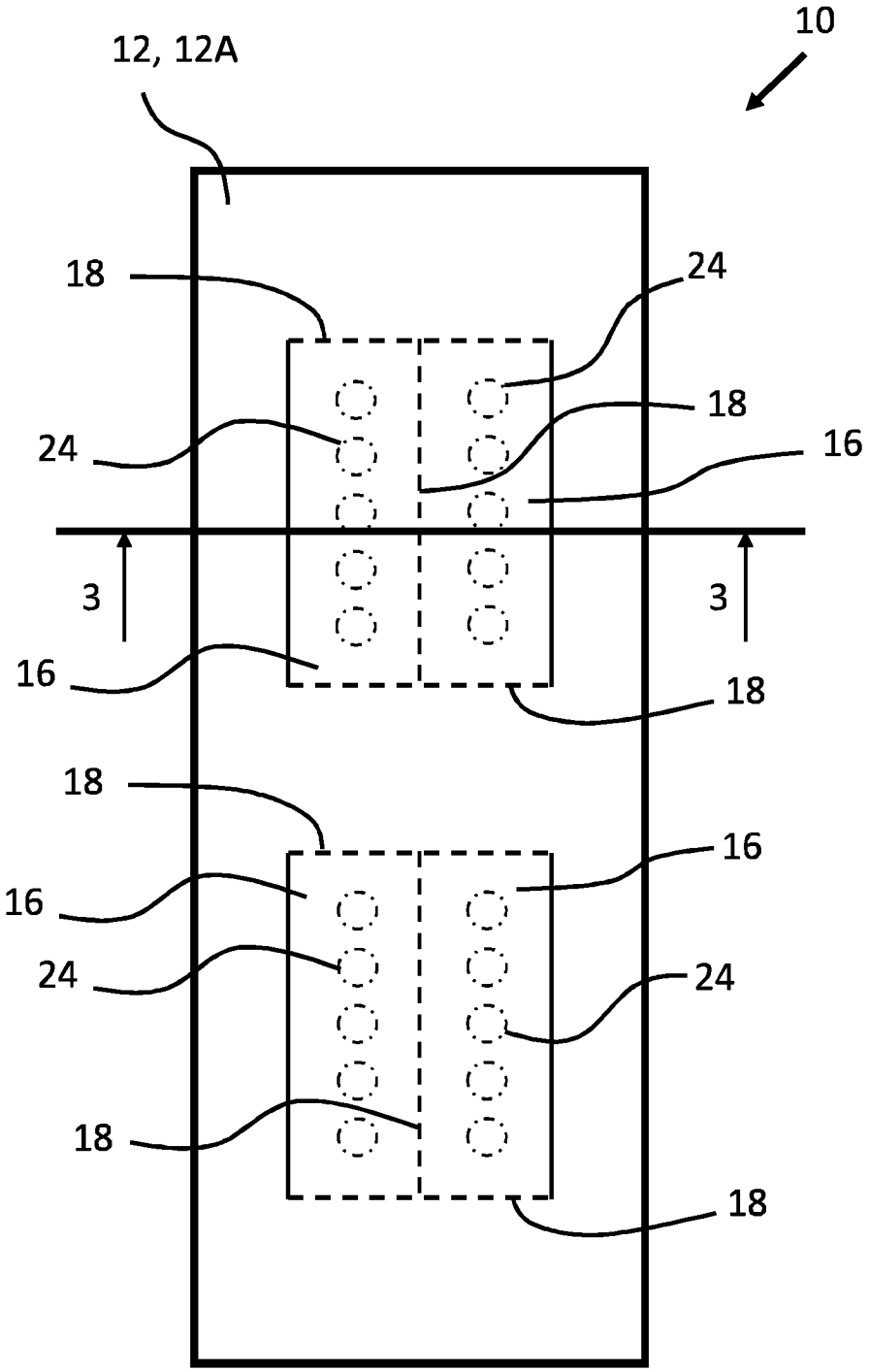
FIG. 1 is a bottom view of packaging in accordance with the present teachings.

The explanations and illustrations presented herein are intended to acquaint others skilled in the art with the invention, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to packaging. The packaging may function to secure one or more items during transportation, storage, or both. The packaging may function to house one or more blister cards, increase structural integrity of the blister cards, or both. The packaging may contain a single layer or may include a plurality of layers. The packaging may include one or more cavities, one or more apertures, one or more holes, or a combination thereof. The packaging may be any size and shape for a desired product. For example, the packaging may be shaped substantially similar to one or more items secured within the packaging to decrease the overall dimensions of the packaging. Alternatively, or in addition, the packaging may include one or more tabs or extensions around a peripheral edge to secure the packaging to one or more displays in a store. The packaging may be structurally rigid. The packaging may be substantially, or partially flexible. For example, one or more formed cavities of the packaging may have a substantially rigid outer shell while a surrounding area may be substantially flexible.

The packaging may be configured for a variety of industries. The packaging may be used to store, transport, or both one or more items used in the pharmaceuticals, construction, automotive, aeronautical, other consumer industries, or a combination thereof. It is contemplated that the packaging may be customizable to meet the demands or requirements of a desired product. For example, the packaging may include one or more protective coatings, materials, or both to protect the packaging. The one or more protective coatings, materials, or both may be moisture-resistant, heat-resistant, debris-resistant, puncture-resistant, tear-resistant, ultraviolet (UV) resistant, antimicrobial, antifungal, or a combination thereof. The one or more protective coatings, materials, or both may then be selected based on a desired application. For example, if the packaging is used to package pharmaceuticals, the packaging may include UV- and moisture-resistant coatings to protect the pharmaceuticals from outside UV light or moisture during transport, storage, or both.

The packaging may include an outer card. The outer card may function to house one or more blister cards. The outer card may function to increase structural integrity of the one or more blister cards. The outer card may secure the blister cards during use by a consumer. The outer card may provide access to the one or more blister cards. For example, the one or more blister cards may be accessed through, and removed from, the outer card. The outer card may be a single layer or may include a plurality of layers secured to each other. For example, the outer card may be a single layer folded around one or more blister cards to form a clamshell-like structure, thereby securing the one or more blister cards between the folded portions of the single layer. Alternatively, the outer card may include separate layers that are secured to one another to form a sandwich-like structure.

The outer card may be customizable and tunable based on a desired application. The customization and tunability may be based on the appearance, dimensions, structural characteristics, or a combination thereof of the outer card. For example, the material characteristics of the outer card may be modified to adjust the coloring of the outer card. The outer card may be tuned to adjust material characteristics, such as elasticity, rigidity, density, ductility, hardness, strength, brittleness, transparency, or a combination thereof. For example, the outer card material may be selected to provide a substantially flexible material that promotes bending of the outer card.

The outer card may be made from any desired materials. It is contemplated that a variety of materials may be suitable to form the outer card. The outer card may be formed of one or more recyclable materials. The one or more recyclable materials may be paperboard, cardboard, corrugated fiberboard, polyethylene terephthalate (PET), high-density polyethylene (HDPE), polyvinyl chloride (PVC), low-density polyethylene (LDPE), polypropylene (PP), polystyrene (PS), acrylic, nylon, polycarbonate, polylactic acid, or a combination thereof.

The outer card may be manufactured using a variety of methods. The outer card may be thermoformed, cold pressed, stamped, molded, corrugated, calendering, or a combination thereof. The outer card may be die cut or trimmed to form a desired shape of the outer card. As a result, the outer card my include one or more holes, punch outs, perforations, or a combination thereof.

The outer card may include a backing. The backing may function to seal one or more blister cards within the outer card. The backing may function as an access panel to the one or more blister cards. The backing may be substantially planar. The backing may include one or more contours, one or more bumps, one or more undulations, one or more arcuate portions, or a combination thereof. The backing may have one or more chamfered edges, rounded edges, flat edges, or a combination thereof. The backing may include one or more tabs, extended portions, fingers, holes, voids, or a combination thereof. The backing may be flexible to allow a user to bend the backing. For example, a user may apply a compression force (e.g., a squeezing force) to opposing edges of the backing to bend the backing, flex the backing, or both. Alternatively, the backing may be substantially rigid to prevent bending of the backing.

The backing may be secured to a shell. The shell may function to house the one or more blister cards. The shell may function in conjunction with the backing to form the outer card. The shell may be formed in a similar manner to the backing. For example, the shell may be a substantially mirrored-image of the backing. Alternatively, the size and shape of the shell may be different than the backing. The shell may include one or more undulations, voids, hollow portions, curves, or a combination thereof while the backing is substantially planar. A peripheral edge of the shell may substantially align with a peripheral edge of the backing to mate the shell to the backing. Alternatively, the shell may have dimensions greater than or less than the dimensions of the backing so that a portion of the shell extends beyond the boundaries of the backing, or vice versa.

The shell may be made of a material similar to or the same as the material of the backing. The shell may comprise one or more materials dissimilar to the composition of the backing. For example, the shell may include one or more plastic portions while the backing is made from paperboard. The shell may be formed monolithically with the backing (i.e., the shell and the backing are made from a single piece of material and are integrally formed with each other). The shell may be a separate layer joined to the backing via one or more adhesives, one or more sealants, one or more fasteners, or a combination thereof. The joining may be free of any adhesives, sealants, or fasteners. For example, the shell and the backing may be joined by materially cross-linking the shell and the backing to form a seal.

The shell may include one or more cavities. The cavities may function to house the one or more blister cards in the outer card. The cavities may be any desired size and shape. The cavities may have a shape substantially similar to a shape of the one or more blister cards. For example, a surface of the cavity may follow a contour of the one or more blister cards so that apertures projecting from the blister card mate with apertures along the cavities. The apertures of the cavities may be positioned anywhere along a surface of the cavities. The cavities may be monolithically formed with the shell. For example, the cavities may be pressed or formed into the shell. The cavities may be positioned anywhere along the shell. The cavities may be a single cavity or a plurality of cavities. For example, there may be one or more cavities, two or more cavities, or three or more cavities. There may be six or less cavities, five or less cavities, or four or less cavities. The cavities may extend inwardly from an outer surface of the shell so that when one or more blister cards are placed in the cavities, the one or more blister cards are substantially flush with, or recessed from, the outer surface of the shell. The cavities may house a single blister card or may house a plurality of blister cards. For example, each cavity may house a pair of opposing blister cards that may be accessed from opposing surfaces of the outer card.

The cavities may be accessed by one or more bay doors. The bay doors may function to allow insertion, removal, or both of the blister cards from the cavities of the outer card. The bay doors may be positioned anywhere along the outer card. The bay doors may be located on the backing, the shell, or both. The bay doors may provide an access point to the one or more blister cards after use of the packaging has been completed. As a result, a user may then remove the one or more blister cards so that the outer card may be recycled and the blister cards may be disposed of appropriately. Accordingly, the bay doors may be substantially or partially sealed relative to the outer card so that the bay doors remain closed during use of the blister packs secured within the outer card. For example, a user may be able to remove one or more items (e.g., medicinal pills) from the sealed apertures of the blister card through the outer card without opening the bay doors. Once all of the one or more items have been removed and disposal of the packaging is necessary, a user may then open the bay doors and remove the one or more blister cards.

The bay doors may be a single door or may be a plurality of doors. The bay doors may be one or more doors, two or more doors, or three or more doors. The bay doors may be six or less doors, five or less doors, or four or less doors. The bay doors may be sets or pairs of bay doors that allow access to each of the one or more blister cards. The bay doors may be positioned anywhere along the shell, the backing, or both. The bay doors may substantially align with one or more cavities of the shell. The bay doors may have dimensions substantially similar to those of the cavities to allow for easy access and/or removal of the blister cards. The bay doors may be hingedly secured to the outer card. The bay doors may remain at least partially secured to the outer card so that, when opened, the bay doors pivot open relative to the backing, the shell, or both while remaining secured to the outer card. The bay doors may be configured for complete removal from the outer card. The bay doors may be monolithically formed with the outer card or may be secured to the outer card via one or more fasteners, one or more adhesives, or both.

The bay doors may include one or more perforations to allow easy opening of the bay doors. The perforations may function to keep the bay doors closed (i.e., preventing access and/or removal of the blister cards) until a user splits or tears the perforations to open the bay doors (i.e., allowing access and/or removal of the blister cards). The perforations may attach the bay doors to the shell, the backing, or both. For example, the bay doors may be monolithically formed with the backing, the shell, or both and the perforations may extend along peripheral edges of the bay doors to form the bay doors within the backing, the shell, or both. The perforations may join a plurality of bay doors to one another. For example, a pair of bay doors located on the backing, the shell, or both may include a perforation seam between the bay doors so that, when broken, the pair of bay doors open in substantially opposing directions. The perforations may be configured to direct opening of the bay doors in a desired opening direction.

The perforations may be any desired size and shape to promote opening of the bay doors at a desired time or with a desired force. The perforations may be spaced apart any desired amount and may extend in any desired direction. The perforations may be substantially linear segments or may include one or more arcuate portions. The perforations may be used in conjunction with one or more additional aids to help a user open the one or more bay doors.

The bay doors may include one or more tabs. The tabs may function as a holding point for a user to grab and open the bay doors. The tabs may be a portion of one or more of the bay doors. The tabs may be located along one or more of the perforations. The tabs may be free of perforations. For example, the bay door may include perforations along a periphery except for a tab extending from the bay door so that a user may grab the tab and tear the perforations to open the bay door. The tab may be formed by cutting around at least a portion of the tab so that the tab may be freely grasped, moved, or both. The tabs may be positioned anywhere along the bay doors. The tabs may project from one or more surfaces of the bay doors. The tabs may be a notched, flexible portion within the boundaries of the bay doors that may be freely accessed by a user to pull the bay door open.

The one or more tabs may be used in conjunction with, or in lieu of, one or more holes. The holes may function as an access point for a user to leverage open one or more bay doors. The holes may provide a user an entry point to grasp at least a portion of the bay doors to open the bay doors. For example, a user may insert one or more fingers or a tool into the hole and provide leverage on the bay doors so that the perforations surrounding the bay doors are split and the bay doors may open freely. The holes may be located anywhere along the bay doors. The holes may be located along one or more perforations of the bay doors. The holes may be any desired size and shape. The holes may extend through a thickness of the backing, the shell, or both where the bay doors are located. The holes may be a plurality of holes.

It is contemplated that a desired force may be applied to the packaging to open the bay doors. The desired force may be a force sufficient enough to break or split the perforations of the bay doors so that the bay doors open freely to allow removal of the blister cards from the outer cards. A desired force may be sufficiently high so that a user may remove items from the one or more blister cards without splitting or breaking the perforations of the bay doors. As such, the bay doors may remain closed during use of the blister cards so that the blister cards are not accidentally removed from the outer card prior to disposal. The force may be applied in any desirable manner that breaks or tears the perforations. The force may be a compression force (i.e., a squeezing force) applied to opposing edges of the shell, the backing, or both that results in bending the shell, the backing, or both, thereby tearing the perforations. Alternatively, the force may be a pull or push force substantially perpendicular to the bay doors to split or tear the perforations. The force may be applied in a direction substantially coaxial with, or parallel to, a direction of removal of the blister cards.

The blister cards may function to house one or more items. The blister cards may be positioned within one or more cavities of the outer card. The blister cards may be fixedly secured to the outer card during use, yet may be removable after use of the blister card is completed. For example, the blister card may be positioned within a cavity of the outer card and secured by a coating to the cavity that maintains a position of the blister card during use. When the blister card needs to be removed, a user may open a bay door of the outer card and remove the blister card from the cavity along with the coating of the blister card. As a result, the outer card may then be free of the blister card or coating and therefore be substantially or fully recyclable.

The blister cards may be any desired size and shape. The blister cards may include a substrate. The substrate may house the one or more items. The blister cards may include a foil disposed on the substrate. The foil may enclose the one or more items within the substrate to protect the one or more items from moisture, debris, light, damage, or a combination thereof. The blister cards may be sized to fit in the one or more cavities of the outer card. The blister cards may be structurally rigid. The blister cards may be at least partially flexible. For example, the blister cards may include flexible portions near the one or more items so that a user may flex the flexible portions to release the one or more items through the foil of the blister cards.

The blister cards may be any desired materials. The blister cards may include a substrate made from plastic, paper, or both. The blister cards may include a foil made of any desired metal. The blister cards may include one or more shields to protect the one or more items secured within the blister cards. For example, the blister cards may include a heat shield, cold shield, or both to protect from high or low temperatures and maintain a condition of the one or more items secured within the blister cards.

The blister cards may include one or more apertures. The apertures may function to secure one or more items within the blister cards. The apertures may be a partial void in the substrate, foil, or both that may house the or more items. The apertures may be any desired size and shape. The apertures may align with apertures located within the cavities along the outer card so that a user may apply a force to the outer card aperture which in turn applies the force to the blister card aperture. As a result, a user may apply a force to the outer card which may allow the user to push one or more items out of the blister cards and through the outer card. The apertures may be positioned anywhere along the blister cards. The apertures may project from one or more surfaces of the blister cards. The apertures may substantially align with one or more punch outs of the outer card.

The punch outs of the outer card may function to allow removal of one or more items secured within the blister cards out of the outer card without opening the bay doors. The punchouts may substantially abut the foil of the blister card and substantially align with one or more of the blister card apertures so that a user may push the one or more items in the apertures through the foil and the punch outs. The punch outs may have dimensions substantially similar to the dimensions of the apertures of the blister card. The punch outs may be perforated or notched to allow for easy removal of the punch outs during use. The punch outs may be monolithically formed with the backing, the shell, or both. The punch out may require a knockout force (i.e., a removal force to remove the punch outs) that is less than a force to break the perforations of the bay door. As such, the punch outs may be removed without causing the bay doors to inadvertently open. To do so, the punch outs may include perforations that are significantly closer to each other and/or larger than the perforations of the bay doors.

The blister card may also include a coating. The coating may function to secure the blister card to the outer card. The coating may function to secure the blister card to the backing, the shell, or both. For example, the blister card may contain a coating that adheres the blister card to an inner surface of a cavity of the shell. The coating may be strategically positioned on desired portions of the blister card so that the blister card may be secured to the outer card during use, yet may be easily removed from the outer card for disposal of the blister card and recycling of the outer card. For example, the coating may only be disposed or partially disposed on an outer surface of the substrate of the blister card that abuts the cavity to secure the blister card to an inner surface of the cavity. The blister card may then be free of coating anywhere along a foil side of the blister card that abuts the backing of the outer card so that the blister card does not adhere to the backing. Therefore, a user may split open bay doors along the backing of the outer card in a desired opening direction, and then remove the blister card in a removal direction away from the cavity through the bay door opening. Because the blister card may only have a coating adjoining the blister card to the inner surface of the cavity, the blister card along with the coating may be easily removed from the outer card so that the outer card may be substantially or completely recyclable. It should be noted that the coating disposed may be disposed directly on the blister card or the outer card and can be any desired amount, shape, or both.

The coating may be any desired material that may adhere the blister card to the outer card. The coating may be an adhesive. The coating may be another material that includes adhesive properties. For example, the coating may be an ultraviolet (UV) coating, moisture-resistant coating, other protective coating, or a combination thereof that may also adhere the blister card to the shell, the backing, or both.

While a coating may be applied to the blister card, the outer card, or both to secure the blister card to the outer card, a sealant may be disposed around one or more blister cards to secure the outer card around the one or more blister cards. The sealant may function to join the backing and the shell of the outer card. The sealant may be disposed on one or more surfaces of the shell, the backing, or both so that the shell and the backing may be secured to one another. The sealant may be positioned outside of a perimeter of the one or more cavities, one or more blister cards, one or more bay doors, or a combination thereof so that the sealant does not prevent the one or more bay doors from opening, the one or more blister cards from being removed from the outer card, or both. The coating may be any desired size, shape, thickness, or a combination thereof. The coating may be any desired sealant material that may join the backing and the shell to each other. For example, the coating may be a rubber cement that bonds the backing to the shell during a pressing of the outer card.

Turning now to the figures, FIG. 1 illustrates a bottom view of packaging 10. The packaging 10 includes an outer card 12. The outer card 12 includes a backing 12A sealed to a shell (not shown) of the card 12. As illustrated, the backing 12A includes two sets of bay doors 16. Each set of bay doors 16 is joined by a perforation 18. The bay doors 16 are configured to split the perforation 18 adjoining the bay doors 16 as well as a plurality of peripheral perforations 18 (see FIG. 3). Each bay door 16 includes a plurality of punch outs 24 that align with associated apertures of one or more blister cards secured within the outer card 12 (see FIG. 2).

Figure 2:
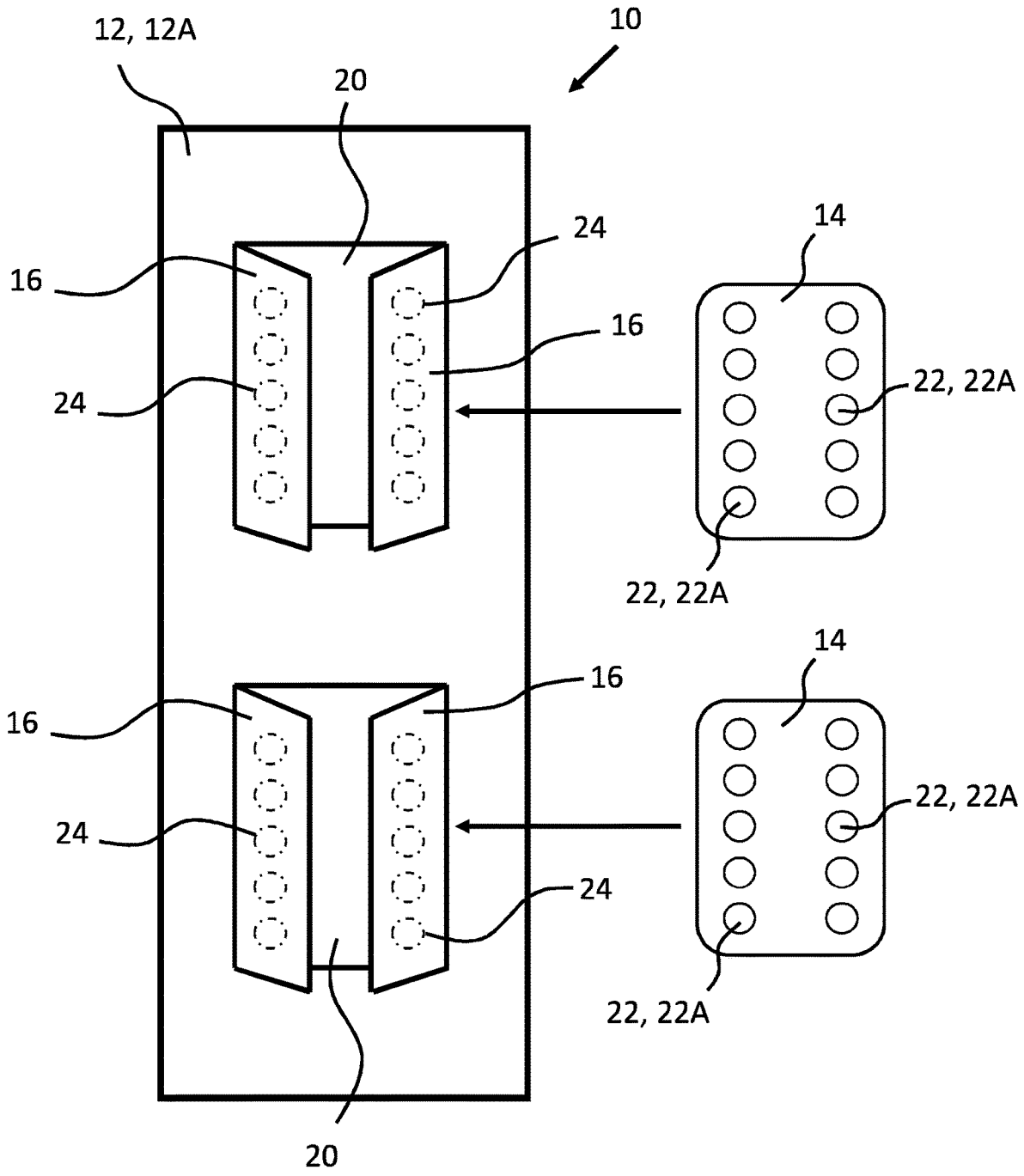
FIG. 2 is a bottom view of packaging having a pair of blister cards removed.

FIG. 2 illustrates a bottom view of packaging 10. The packaging 10 includes an outer card 12. The outer card 12 includes a backing 12A sealed to a shell (not shown) of the card 12. As illustrated, the backing 12A includes two sets of bay doors 16. The bay doors 16 are configured to open so that one or more blister cards 14 may be inserted, removed, or both from cavities 20 of the outer card 12. Each blister card 14 includes a plurality of apertures 22A that align with punchouts 24 of the bay doors 16 so that a user may remove an item (e.g., medication) contained in each aperture 22 without opening the bay doors 16.

Figure 3:
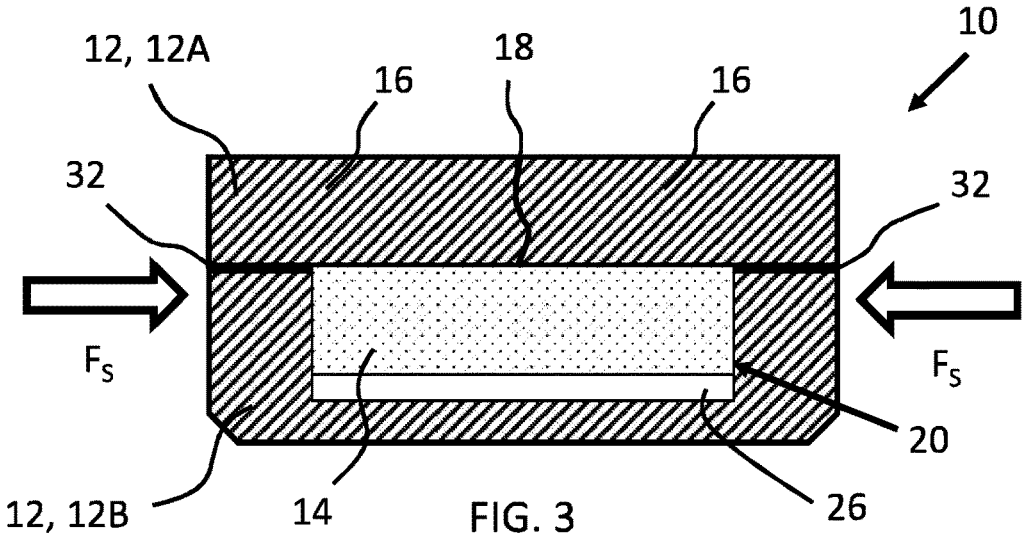
FIG. 3 is cross-section 3-3 of FIG. 1.
Figure 4:
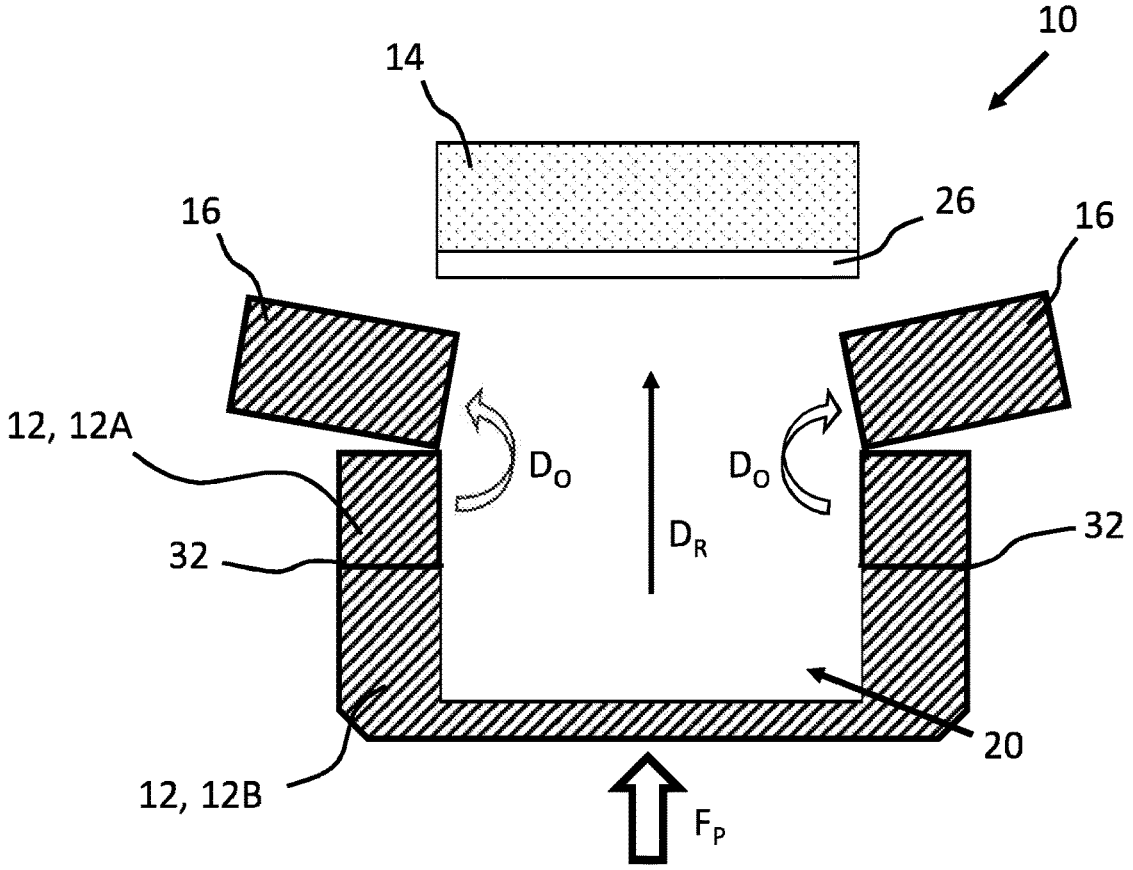
FIG. 4 illustrates removal of a blister card from the packaging shown in FIG. 3.

FIGS. 3 and 4 illustrate cross-section 3-3 of the packaging 10 of FIG. 1. The packaging 10 includes an outer card 12 having a shell 12B secured to a backing 12A via sealant 32. The outer card 12 includes a cavity 20 configured to house a blister card 14. The backing 12A includes a pair of bay doors 16 joined via a perforation 18. The bay doors 16 are configured to open when a squeezing force ($F_S$) is applied to the outer card 12 to break the perforation 18 (see FIG. 4). The squeezing force ($F_S$) may be applied to edges of the backing 12A, edges of the shell 12B, other opposing points along the outer card 12, or a combination thereof. The blister card 14 includes a coating 26 disposed on a surface that abuts the shell 12B to decrease adhesion between the blister card 14 and the shell 12B so that the blister card 14 may be easily removed from the cavity 20 when the bay doors 16 are open. As illustrated, the sealant 32 joins the backing 12A and the shell 12B around a peripheral of the cavity 20 to prevent adhesion between the backing 12A and the blister card 14, thereby allowing removal of the blister card 14 from the cavity 20.

FIG. 4 illustrates removal of the blister card 14 from the packaging 10 shown in FIG. 3. As illustrated, after the squeezing force ($F_S$) is applied to the outer card 12, the seam between the bay doors 16 of the backing 12A is split, thereby allowing the bay doors 16 to rotate open in an opening direction ($D_O$) while the backing 12A and the shell 12B remained sealed to each other via the sealant 32. Once the bay doors 16 are open, a push-out force ($F_P$) is applied to the shell 12B to deform the cavity 20 and promote removal of the blister card 14 from the cavity 20. It should be noted, however, that a push-out force ($F_P$) may not be needed to remove the blister card 14 from the cavity 20. After application of the push-out force ($F_P$), the blister card 14 may be removed, along with the coating 26 disposed on the surface of the blister card 14, from the cavity 20 in a removal direction ($D_R$).

Figure 5A:
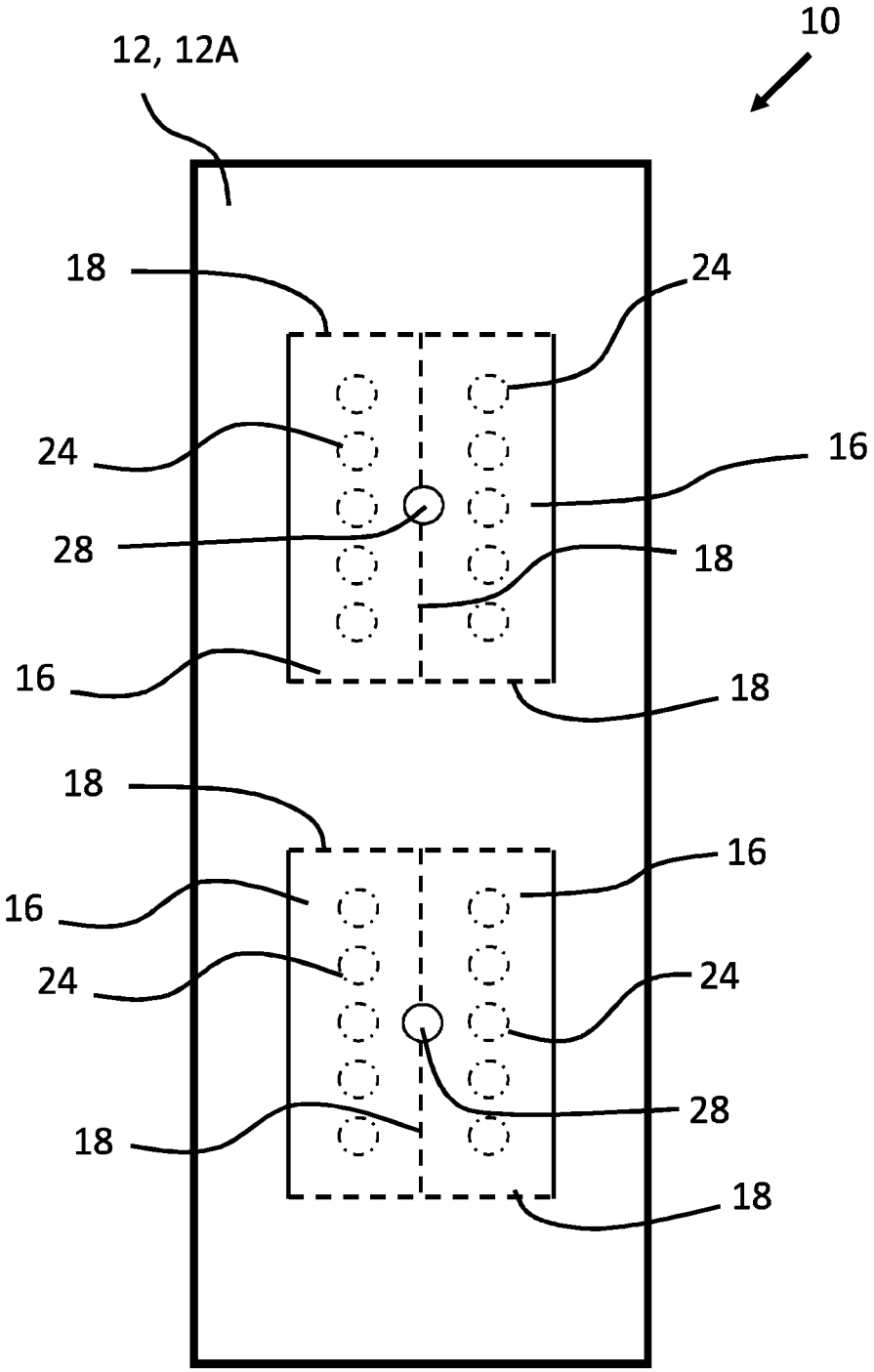
FIG. 5A is a bottom view of packaging in accordance with the present teachings.

FIG. 5A illustrates a bottom view of packaging 10. The packaging 10 includes an outer card 12. The outer card 12 includes a backing 12A sealed to a shell (see FIG. 3) of the card 12. As illustrated, the backing 12A includes two sets of bay doors 16. Each set of bay doors 16 is joined by a perforation 18. The bay doors 16 are configured to split the perforation 18 adjoining the bay doors 16 as well as a plurality of peripheral perforations 18 (see FIG. 3). A hole 28 located along the perforation 18 adjoining the bay doors 16 allows a user to manually split the perforations 18 and open the bay doors 16. Each bay door 16 includes a plurality of punch outs 24 that align with associated apertures of one or more blister cards secured within the outer card 12 (see FIG. 2).

Figure 5B:
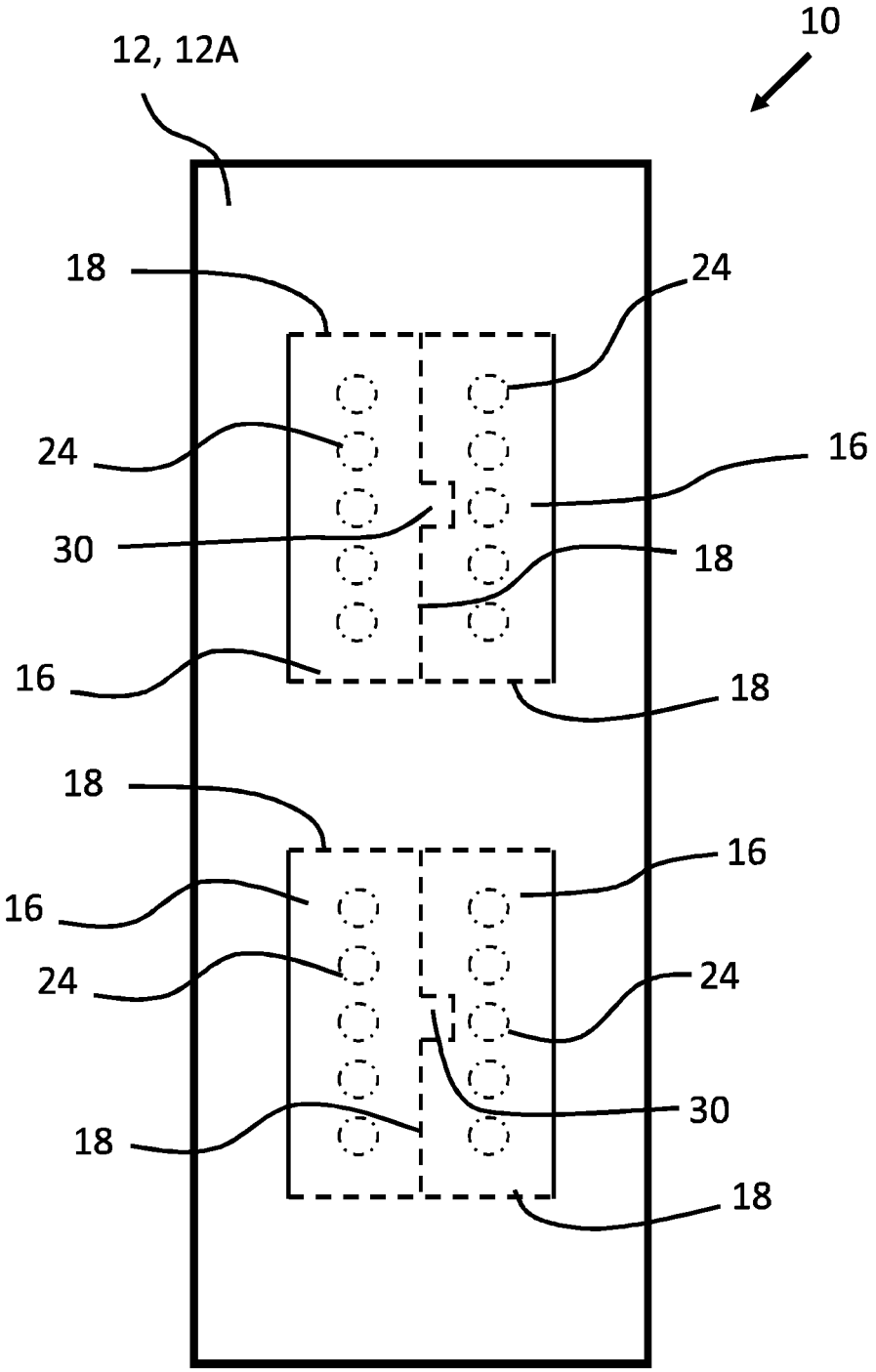
FIG. 5B is a bottom view of packaging in accordance with the present teachings.

FIG. 5B illustrates a bottom view of packaging 10. The packaging 10 includes an outer card 12. The outer card 12 includes a backing 12A sealed to a shell (see FIG. 3) of the card 12. As illustrated, the backing 12A includes two sets of bay doors 16. Each set of bay doors 16 is joined by a perforation 18. The bay doors 16 are configured to split the perforation 18 adjoining the bay doors 16 as well as a plurality of peripheral perforations 18 (see FIG. 3). A tab 30 located along the perforation 18 adjoining the bay doors 16 allows a user to manually split the perforations 18 and open the bay doors 16. Each bay door 16 includes a plurality of punch outs 24 that align with associated apertures of one or more blister cards secured within the outer card 12 (see FIG. 2).

Figure 6:
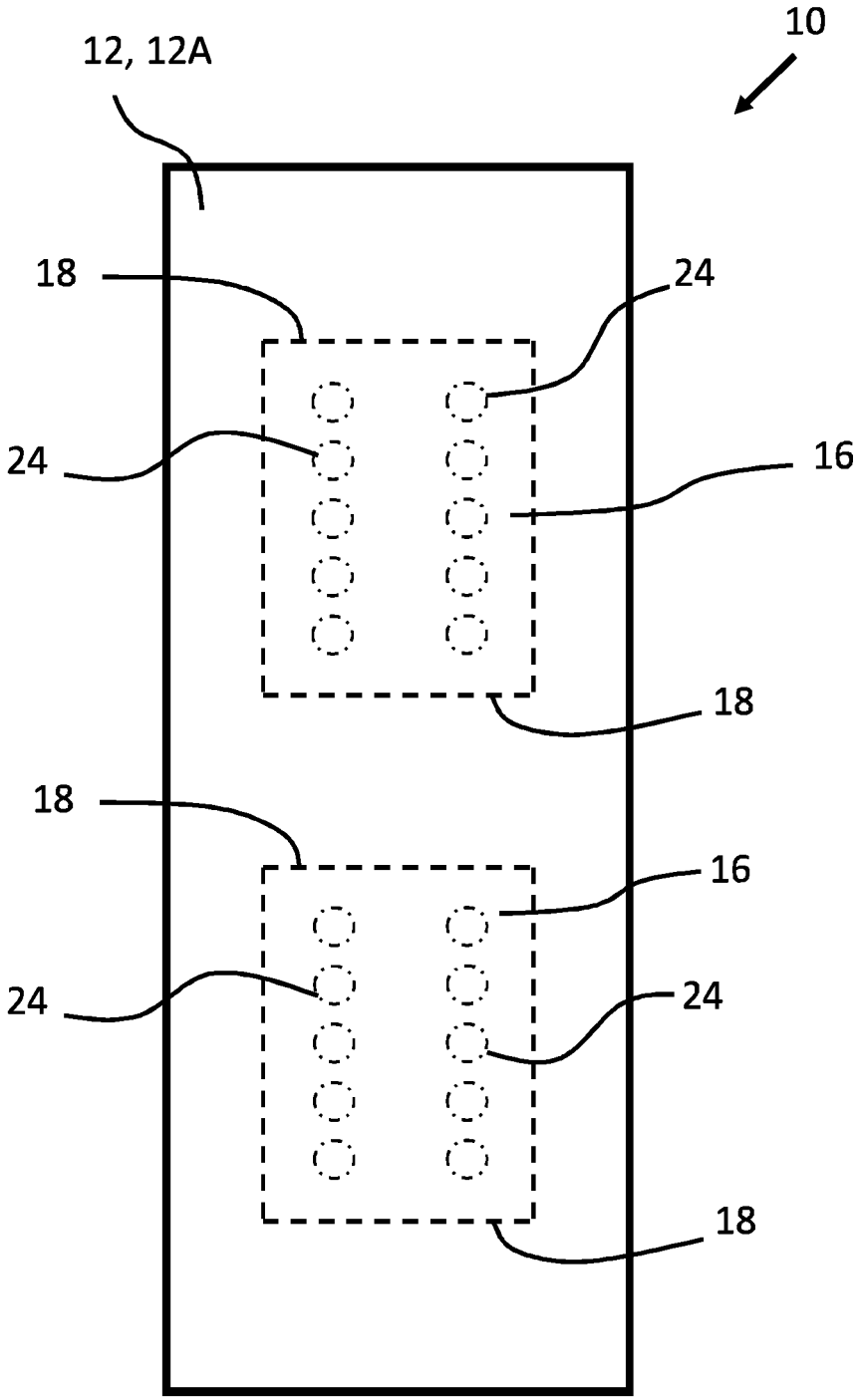
FIG. 6 is a bottom view of packaging having individual bay doors in accordance with the present teachings.

FIG. 6 illustrates a bottom view of packaging 10. The packaging 10 includes an outer card 12. The outer card 12 includes a backing 12A sealed to a shell (see FIG. 3) of the card 12. As illustrated, the backing 12A includes two individual bay doors 16 instead of the sets of bay doors 16 (see for comparison FIGS. 5A and 5B). The bay doors 16 are configured to split perforations 18 along a perimeter of the bay doors 16. It should be noted that while the bay doors 16 as illustrated include perforations 18 along each peripheral edge, one or more of the peripheral edges may be free of a perforation 18 so that the bay doors 16 remain secured to the backing 12A after being open. Each bay door 16 includes a plurality of punch outs 24 that align with associated apertures of one or more blister cards secured within the outer card 12 (see FIG. 2).

Figure 7:
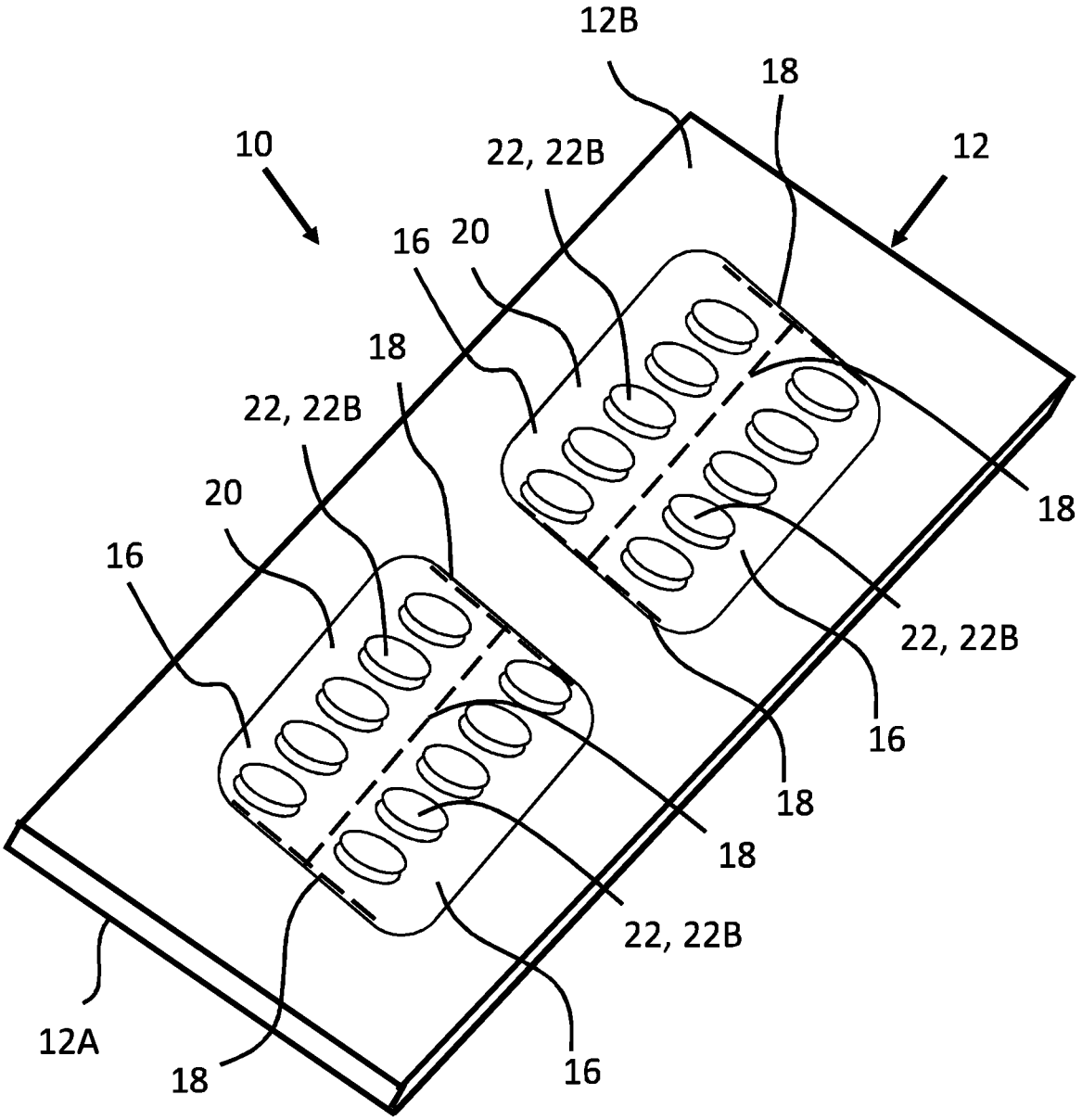
FIG. 7 is a top-down perspective view of packaging in accordance with the present teachings.

FIG. 7 illustrates a top-down perspective view of packaging 10 in accordance with the present teachings. The packaging 10 includes an outer card 12 having a backing 12A sealed to a shell 12B (sealant not shown). The shell 12B includes a plurality of cavities 20 configured to house blister cards of the packaging 10 (see FIGS. 2-4). The shell 12B also includes a plurality of apertures 22B that align with apertures of the blister cards located within the cavities 20 so that a user may apply a force to the apertures 22B, which in turn, applies a force to the apertures of the blister cards (see FIGS. 3 and 4). As illustrated, the shell 12B includes two sets of bay doors 16. Each set of bay doors 16 is joined by a perforation 18. The bay doors 16 are configured to split the perforation 18 adjoining the bay doors 16 as well as a plurality of peripheral perforations 18 (see FIG. 3).

Figure 8:
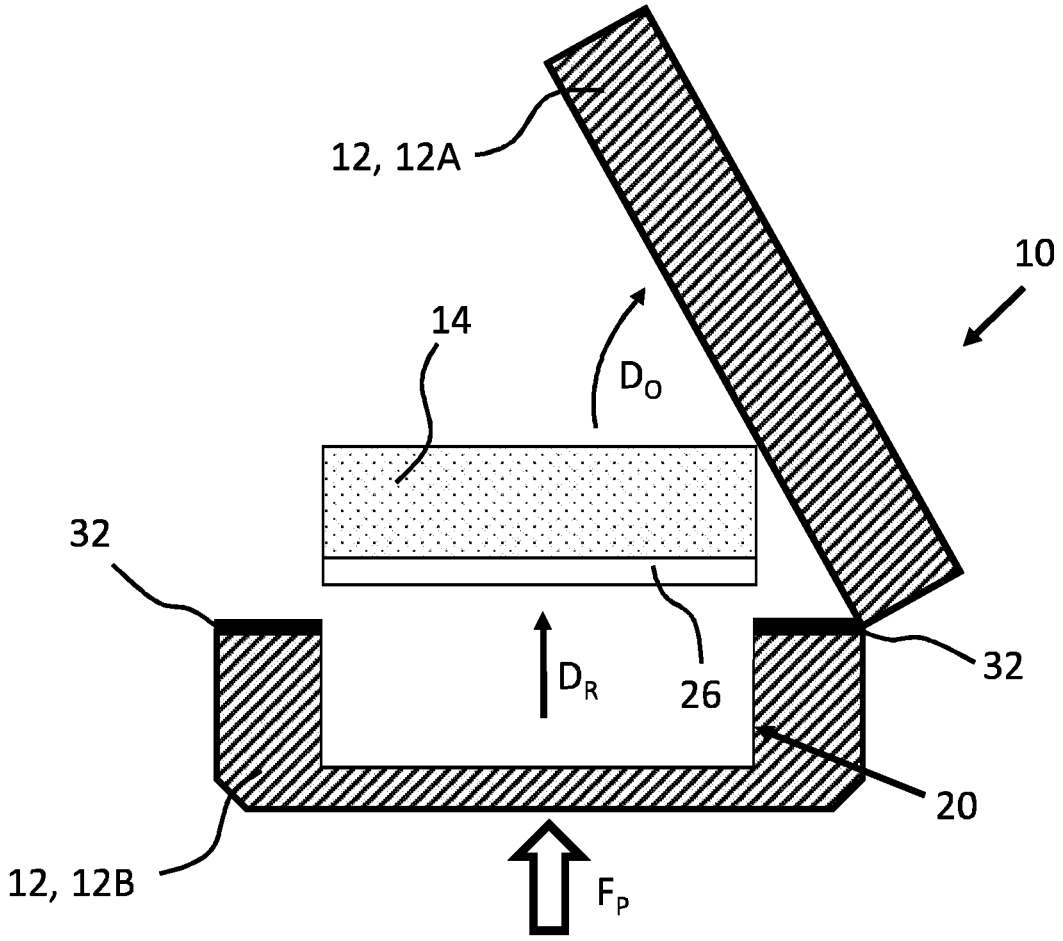
FIG. 8 is a cross-sectional view illustrating removal of a blister card from packaging.

FIG. 8 is a cross-sectional view illustrating removal of a blister card 14 from packaging 10. The packaging 10 includes an outer card 12 having a shell 12B secured to a backing 12A via sealant 32. The outer card 12 includes a cavity 20 configured to house the blister card 14. The outer card 12 is configured to be separated by tearing, peeling, or both the backing 12A from the shell 12B in an opening direction ($D_O$) along the sealant 32 seams joining the backing 12A and the shell 12. The blister card 14 includes a coating 26 disposed on a surface that abuts the shell 12B to decrease adhesion between the blister card 14 and the shell 12B so that the blister card 14 may be easily removed from the cavity 20. As illustrated, the sealant 32 joins the backing 12A and the shell 12B around a peripheral of the cavity 20 to prevent adhesion between the backing 12A and the blister card 14, thereby allowing removal of the blister card 14 from the cavity 20. Once the backing 12A is opened, a push-out force ($F_P$) is applied to the shell 12B to deform the cavity 20 and promote removed of the blister card 14 from the cavity 20. It should be noted, however, that a push-out force ($F_P$) may not be needed to remove the blister card 14 from the cavity 20. After application of the push-out force ($F_P$), the blister card 14 may be removed, along with the coating 26 disposed on the surface of the blister card 14, from the cavity 20 in a removal direction ($D_R$).

| ELEMENT LIST | |
|---|---|
| 10 | Packaging |
| 12 | Outer Card |
| 12A | Backing |
| 12B | Shell |
| 14 | Blister Card |
| 16 | Bay Door |
| 18 | Perforation |
| 20 | Cavity |
| 22 | Aperture |
| 22A | Blister Card Aperture |
| 22B | Shell Aperture |
| 24 | Punch Out |
| 26 | Coating |
| 28 | Hole |
| 30 | Tab |
| 32 | Sealant |
| $F_S$ | Squeeze Force |
| $F_P$ | Push-Out Force |
| $D_R$ | Removal Direction |
| $D_O$ | Opening Direction |

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

We claim:

1. A packaging comprising:

(a) an outer card having a plurality of cavities, a shell forming each of the plurality of cavities, a backing secured to said shell and at least one access door located on the backing of the outer card, the at least one access door comprising one or more perforations; and (b) a plurality of blister cards, each of the plurality of blister cards housed within a respective one of the plurality of cavities, wherein the each of the plurality of blister cards is removable from the respective one of the plurality of cavities, through said at least one access door, so that the each of the plurality of blister cards are disposable separate from the outer card, wherein the at least one access door includes punch outs that align with corresponding apertures of each of the plurality of blister cards secured within the respective one of the plurality of cavities so that one or more items secured within the apertures are removable without opening the at least one access door, the punch outs being configured such that a first force applied to the outer card is sufficient for forcing the one or more items out of one or more of the plurality of blister cards through the punch outs and through the outer card, and the one or more perforations of the at least one access door being configured such that a second force for breaking the one or more perforations is greater than the first force and is sufficiently high that the one or more items may be removed from the one or more of the plurality of blister cards without breaking the one or more perforations of the at least one access door.

2. The packaging according to claim 1, wherein the at least one access door comprises a pair of access doors joined to each other by said one or more perforations.

3. The packaging according to claim 2, wherein the backing and the shell are secured to one another via a sealant between the backing and the shell such that, in a configuration in which the one or more perforations are split, the pair of access doors are configured to rotate open while the backing and the shell remain sealed to each other via the sealant.

4. The packaging according to claim 2 wherein the one or more perforations joining the pair of access doors are formed parallel to a longitudinal direction of each of the pair of access doors, and wherein each of the pair of access doors further comprise a plurality of peripheral perforations such that, in a configuration in which the one or more perforations and the plurality of peripheral perforations are split, each of the pair of access doors comprises at least three free edges.

5. The packaging according to claim 1, wherein the one or more perforations are split when a squeezing force is applied to outer edges of the backing.

6. The packaging according to claim 1, wherein each of the plurality of blister cards includes a coating on one or more surfaces to prevent or decrease adhesion between the each of the blister cards and the backing, the shell, or both, wherein the one or more surfaces includes a surface that abuts the shell to decrease adhesion between each of the plurality of blister cards and the shell.

7. The packaging according to claim 6, wherein the coating disposed on each of the plurality of blister cards is an ultraviolet (UV) coating.

8. The packaging according to claim 1, wherein a hole is positioned along the at least one access door so that a user may manually split the one or more perforations.

9. The packaging according to claim 1, wherein the at least one access door includes a tab so that a user may manually split the one or more perforations.

10. The packaging according to claim 1, wherein the shell further includes apertures within an area forming each of the plurality of cavities that align with apertures of respective ones of the plurality of blister cards secured in the respective one of the plurality of cavities.

11. The packaging according to claim 1, wherein the outer card comprises paperboard and is recyclable once the plurality of blister cards are removed from the packaging.

12. The packaging according to claim 1, wherein the backing and the shell are secured to one another via a sealant between the backing and the shell.

13. The packaging according to claim 12, wherein the sealant is at least partially disposed around the each of the plurality of cavities so that respective one of the plurality of blister cards remain unadhered or only partially adhered to the outer card.

14. The packaging according claim 12, wherein the sealant between the backing and the shell has a thickness of less than about 10 mm.

15. The packaging according to claim 1, wherein once the one or more perforations are split, the at least one access door hingedly pivots relative to the backing and the at least one access door remains secured to the backing when opened.

16. The packaging according to claim 1, wherein the at least one access door is monolithically formed with the backing.

17. The packaging according to claim 1, wherein each of the plurality of blister cards are removed from a respective one of the plurality of cavities by applying a force to an outer portion of the shell forming the respective one of the plurality of cavities.

18. The packaging according to claim 1, wherein each of the plurality of blister cards are removed from the outer card by separating the backing from the shell.

19. The packaging according to claim 1, wherein each of the plurality of blister cards are free of adherence with the backing, the shell, or both so that each of the plurality of blister cards can be removed from the respective one of the plurality of cavities.

20. The packaging according to claim 1, wherein the punch outs includes perforations, wherein the perforations of the punch outs are closer to each other, and/or larger, than the one or more perforations of the at least one access door.

21. A packaging comprising:

(a) an outer card having a plurality of cavities, a shell forming each of the plurality of cavities, a backing secured to said shell and at least one access door located on the backing of the outer card, the at least one access door comprising one or more perforations, wherein the at least one access door includes punch outs comprising perforations, wherein the perforations of the punch outs are closer to each other, and/or larger, than the one or more perforations of the at least one access door; and (b) a plurality of blister cards, each of the plurality of blister cards housed within a respective one of the plurality of cavities, wherein the each of the plurality of blister cards is removable from the respective one of the plurality of cavities, through said at least one access door, so that the each of the plurality of blister cards are disposable separate from the outer card.

* * * * *